United States Patent [19]

Catoe

[11] Patent Number: 5,022,105

[45] Date of Patent: Jun. 11, 1991

[54] MOBILE LIFT-ASSISTED PATIENT TRANSPORT DEVICE FOR FIELD USE

[76] Inventor: Michael Catoe, 1282 St. Peter's Church Rd., Lexington, S.C. 29072

[21] Appl. No.: 498,940

[22] Filed: Mar. 26, 1990

Related U.S. Application Data

[63] Continuation-in-part of Ser. No. 389,867, Aug. 4, 1989, abandoned.

[51] Int. Cl.[5] ..... A61G 1/02; A61G 7/00

[52] U.S. Cl. ..... 5/11; 5/63; 5/86; 296/20

[58] Field of Search ..... 5/11, 62, 63, 86; 296/20; 254/93 HP

[56] References Cited

U.S. PATENT DOCUMENTS

| | | | |
|---|---|---|---|
| 2,070,960 | 2/1937 | Phillips | 254/93 HP |
| 2,521,214 | 9/1950 | Goeller . | |
| 2,833,587 | 5/1958 | Saunders . | |
| 2,958,873 | 11/1960 | Ferneau | 5/63 X |
| 3,174,722 | 3/1965 | Alm | 5/63 X |
| 3,308,485 | 3/1967 | Nesbit-Evans . | |
| 3,336,606 | 8/1967 | Beitzel | 5/63 X |
| 3,380,085 | 4/1968 | Ferneau et al. . | |
| 3,472,183 | 10/1969 | Goodman . | |
| 3,644,944 | 2/1972 | Bourgraf et al. . | |
| 3,686,696 | 8/1972 | Lanigan . | |
| 3,742,527 | 7/1973 | Johnston et al. . | |
| 3,743,344 | 7/1973 | Jameson . | |
| 3,805,712 | 4/1974 | Taylor et al. . | |
| 3,917,076 | 11/1975 | Campbell | 5/86 X |
| 4,071,222 | 1/1978 | Wright | 5/62 X |
| 4,078,269 | 3/1978 | Weipert | 5/63 |
| 4,196,483 | 4/1980 | Lefler et al. | 5/63 X |
| 4,489,449 | 12/1984 | Faller et al. . | |
| 4,817,220 | 4/1989 | Guttormsem | 5/63 |
| 4,860,394 | 8/1989 | Benessis et al. | 5/63 X |

FOREIGN PATENT DOCUMENTS

| | | | |
|---|---|---|---|
| 2513512 | 4/1983 | France . | |
| 1198892 | 7/1970 | United Kingdom | 5/63 |

*Primary Examiner*—Michael F. Trettel

*Attorney, Agent, or Firm*—Burns, Doane, Swecker & Mathis

[57] ABSTRACT

A mobile device for transporting patients in the field is power adjustable and includes a frame having a terrain engaging portion connected to a patient supporting portion. The patient supporting portion is height adjustable between a first position adjacent the terrain engaging portion and a second position remote from the terrain engaging portion. A self-contained power device is connected to the frame for adjusting the height of the patient supporting portion relative to the terrain engaging portion. An actuator is operably connected for actuating the self contained power device whereby manual adjustment of the patient supporting portion relative to the terrain engaging portion is avoided. The patient supporting portion has a plurality of sections adjustable relative to each other. The self-contained power device provides adjustment for the sections independently of each other and independently of the height adjustment.

9 Claims, 10 Drawing Sheets

MOBILE LIFT-ASSISTED PATIENT TRANSPORT DEVICE FOR FIELD USE

BACKGROUND OF THE INVENTION

This application is a continuation-in-part application of U.S. application Ser. No. 389,867, filed on Aug. 4, 1989, now abandoned.

1. Field of the Invention

The present invention relates generally to invalid lift and transfer devices and more particularly to a mobile, lift-assisted device for transferring a patient from a remote location to a hospital or similar facility.

2. Background Description

A busy Emergency Medical Services (EMS) crew may handle as many as 20 calls during a work shift. Typically one or more such calls involve moving a patient from a field location, such as his home or the scene of an accident, to a health care facility such as an emergency room at a hospital.

Providing transport for the patient involves various procedures for appropriately securing the patient in different transport vehicles for transport to the hospital or other appropriate destination. Such transport involves a constant risk to the EMS crew and to the patient. The risk arises from the activity involving the EMS crew, usually two persons, lifting and moving the patients. There is also the danger that the patient may be dropped or roughly handled while being moved. As for the EMS crew, they are routinely faced with lifting situations which can and often do result in significant and even crippling back injuries. This can occur either because of repetitive lifting of average size patients or occasional lifting of large patients.

The dangers of lifting-related injury is compounded because an EMS crew must lift a patient approximately 7 times during the course of a call. For example, for lifting purposes only, in an emergency involving a 200 lb. man the crew must: 1) lift the patient to a mobile, wheeled device placed at its lowest height adjustment; 2) lift the device and patient to the maximum height adjustment, and then move the device and patient to an ambulance; 3) lower the device and patient back to the lowest height adjustment; 4) lift the device and patient into the ambulance; 5) upon arrival at the medical facility, remove the device and patient from the ambulance and lower them to the ground; 6) again lift the device and patient to the maximum height adjustment, and then move the device and patient into the facility; and 7) lift to transfer the patient from the device to a bed at the facility. During this very typical call the crew has lifted or lowered the patient seven times, thereby doing an amount of work equivalent to lifting more than 1400 pounds when the weight of the device is included.

A particularly difficult part of this process results from the fact that the typical device that is used in the field, e.g., a stretcher for transfer of patients via ambulances, is not well-designed for lifting and lowering. Because of the location of the undercarriage and supporting structure, the members of the EMS crew cannot simply stand on each side of the device and lift or lower it using proper lifting techniques with their legs. Rather, to avoid hitting the undercarriage with their knees, they must turn their bodies sideways, imposing a torquing motion on their backs as they lift and lower. This consequence results in a significant number of disabling back injuries to EMS personnel each year. In addition, because of the strength that is required to lift and lower a device with this type of motion, smaller people, particularly women, are effectively precluded from working as emergency medical technicians.

The foregoing illustrates that it would be advantageous to provide a patient transport device having a lift assisting mechanism, to overcome the need for an EMS crew to exert a great amount of lifting force during a routine emergency call.

Although several such patient transport devices have been proposed, all are too cumbersome to be practically implemented. One example of such a device is found in U.S. Pat. No. 2,833,587 to Saunders which discloses an adjustable height gurney which includes power cylinders provided in the legs of the upper frame and connected to two of the intersecting lever arms (one on each side of the gurney). To operate the cylinders, the EMS technician repeatedly works the handle of a grip up and down to actuate the hydraulic pump. As an alternative, a valve connects the power cylinders to the fluid reservoir, which valve may be opened by a hand lever connected thereto. Both mechanisms for actuating the hydraulic pump cause problems in operation. Use of the handle, which requires repeatedly working the handle up and down is time consuming and can be quite difficult when a patient is on the gurney. Further, in order to remove the gurney from the ambulance, or to place it in the ambulance, the EMS technicians must lift the stretcher, and the patient, from the ambulance to the ground, and visa versa. Then the technicians can use the grip or hand lever to raise the upper carriage. The gurney in the Saunders patent does not provide a means for raising and lowering the lower carriage, in addition to raising and lowering the upper carriage.

SUMMARY OF THE INVENTION

One object of the invention is to provide a mobile, lift-assisted patient transport device comprising a frame having an undercarriage interconnected with a patient supporting portion. The patient supporting portion is height adjustable between a first position adjacent the undercarriage and a second position, vertically displaced from the undercarriage. Self-contained power units are connected to the frame for adjusting the height of the patient supporting portion relative to the undercarriage. Switches are provided for actuating the self-contained power units whereby manual adjustment of the patient supporting portion relative to the undercarriage is avoided.

The foregoing and other aspects of the invention will become apparent from the following detailed description of the invention when considered in conjunction with the accompanying drawing figures, wherein like numbers refer to like elements. It will be readily appreciated that the drawing figures are not intended as a definition of the invention but are for the purpose of illustration only.

BRIEF DESCRIPTION OF THE DRAWING FIGURES

DETAILED DESCRIPTION

Figure 1:
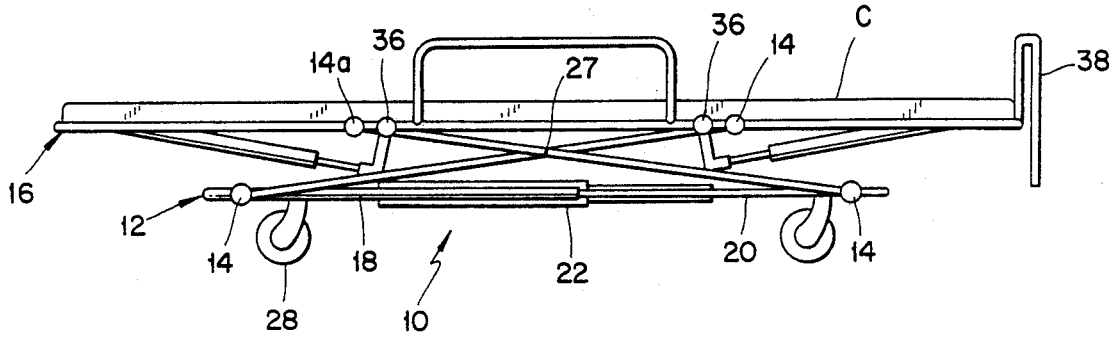
FIG. 1 is a side view illustrating an embodiment of the patient transport device of the present invention in a first or lowered position.
Figure 5:
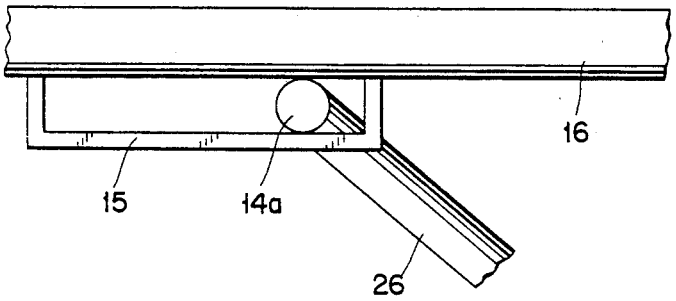
FIG. 5 is an enlarged view of an upper frame portion of the patient transport device of the present invention.
Figure 2:
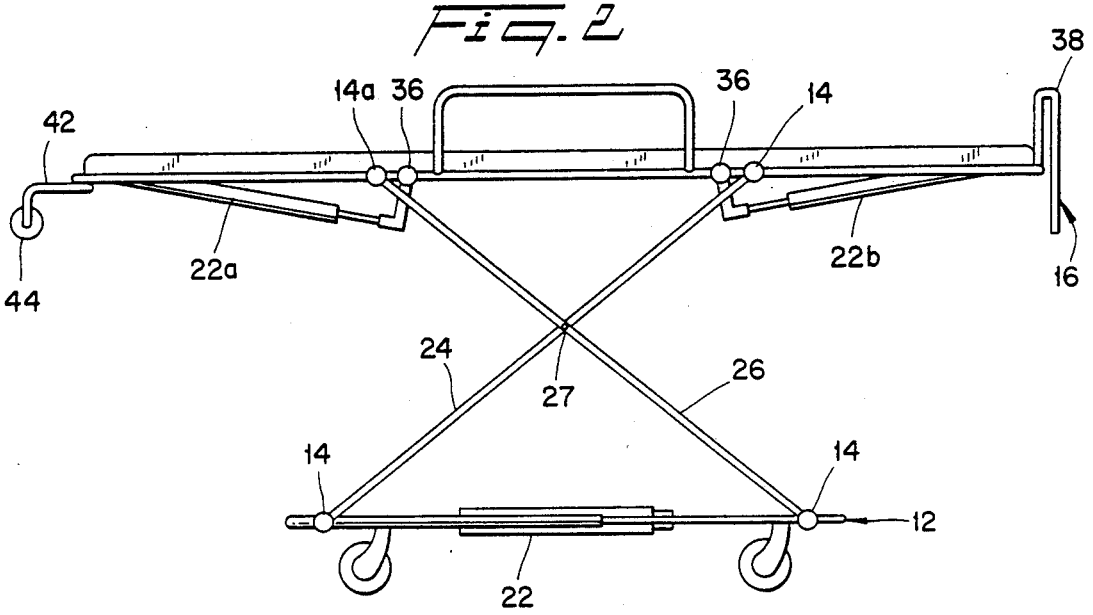
FIG. 2 is a side view illustrating an embodiment of the patient transport device of the present invention in a second or raised position.

Referring now to the drawings, in FIGS. 1 and 2 a mobile, lift-assisted patient transport device designed for field use comprises a frame generally designated 10 and preferably formed of tubular aluminum. The frame 10 includes an undercarriage 12, or terrain engaging portion, pivotally interconnected via a scissors linkage 24, 26 at pivot point 14 and joint 14*a* with a patient supporting portion 16. The two legs 24 and 26 of the scissors linkage are hinged together at a central pivot point 27. The frame 10 is height adjustable between a first position (FIG. 1), wherein the patient supporting portion 16 is adjacent the terrain engaging portion 12, and a second position (FIG. 2), wherein the patient supporting portion 16 is remote from the terrain engaging portion 12. As can be seen in FIG. 5, joint 14*a* is movable within a groove 15 formed on the patient supporting portion 16. In an alternative embodiment (not shown), the joint 14*a* may be formed with a groove on the inside thereof. A pivotable member is provided in the groove which facilitates movement of the joint along the rail of the patient supporting portion 16.

Figure 4:
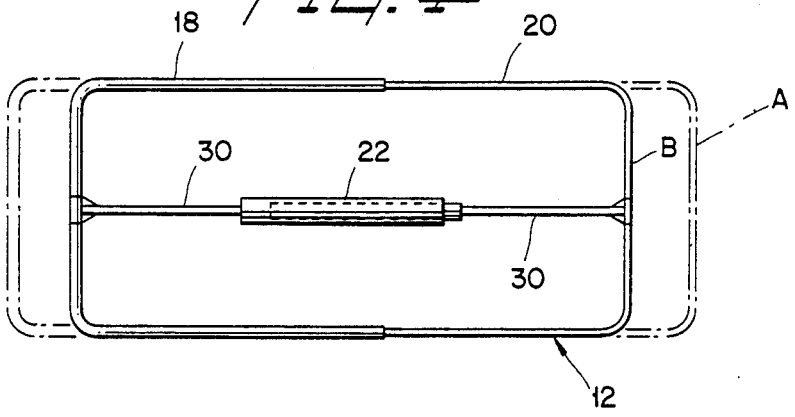
FIG. 4 is a plan view illustrating an embodiment of an adjustable portion of the patient transport device of the present invention.

The terrain engaging portion 12 includes tubular members 18 which telescopingly cooperate with tubular members 20 to form a horizontal rectangular frame. These two members move toward and away from each other in response to actuation of a self-contained lift assisting means 22 carried by the terrain engaging portion 12 via interconnecting arms 30 (see FIG. 4). Actuation of the lift assisting means 22 causes the terrain engaging portion 12 to move between the dotted line and solid line positions A and B, respectively, illustrated in FIG. 4. When the two members 18 and 20 move toward one another to the solid line position B, and the terrain engaging portion 12 is on the ground, pivotal movement of the linkages 24 and 26 raises the patient supporting portion 16 to the second position illustrated in FIG. 2. When the members 18 and 20 move away from one another to the dotted line position A, the pivotal movement of the linkages 24 and 26 lowers the patient supporting portion 16 to the first position illustrated in FIG. 1. To remove the patient transport device from the ambulance, the EMS technicians roll it out of the door until only the wheels 44 are left in the ambulance. One of the technicians then presses the switch 58 (see FIGS. 6–13), and the terrain engaging portion 12 is automatically lowered to the ground. Thus, the EMS technicians need not lift the stretcher and the patient to the ground. Further, when the patient transport device is being loaded into an ambulance from the raised position, the wheels 44 are placed on the ambulance floor and the patient supporting portion 16 is supported by the EMS technicians. The technician then depress the switch 58, which causes the terrain engaging portion 12 to be lifted towards toward the patient supporting portion 12. The device can then be rolled onto the ambulance. For mobility, the terrain engaging portion 12 includes a plurality of omni-directional wheels 28.

This arrangement of the lift-assisting means also enables the patient transport device to be moved between its lowest and highest positions without requiring a large longitudinal movement of the telescoping members 18 and 20 relative to one another. Typically, for the patient supporting portion to go from its lowest to its highest positions it must travel a vertical distance of about two feet. However, within this range of movement the two telescoping members 18 and 20 of the undercarriage only move about eight inches relative to one another. Therefore, the lift assisting device 22 need not provide a large degree of translational movement to be effective.

The lift assisting device 22 is preferably implemented by means of a pneumatic cylinder. This type of device is preferred because it is powered by compressed gas, which is readily available in most EMS environments. More particularly, emergency medical technicians generally have compressed oxygen with them on emergency calls. The tank of oxygen can be easily connected to the pneumatic cylinder 22, and a suitable valve on the tank can be opened and closed to assist in raising and lowering the patient transport device during use.

Figure 12A:
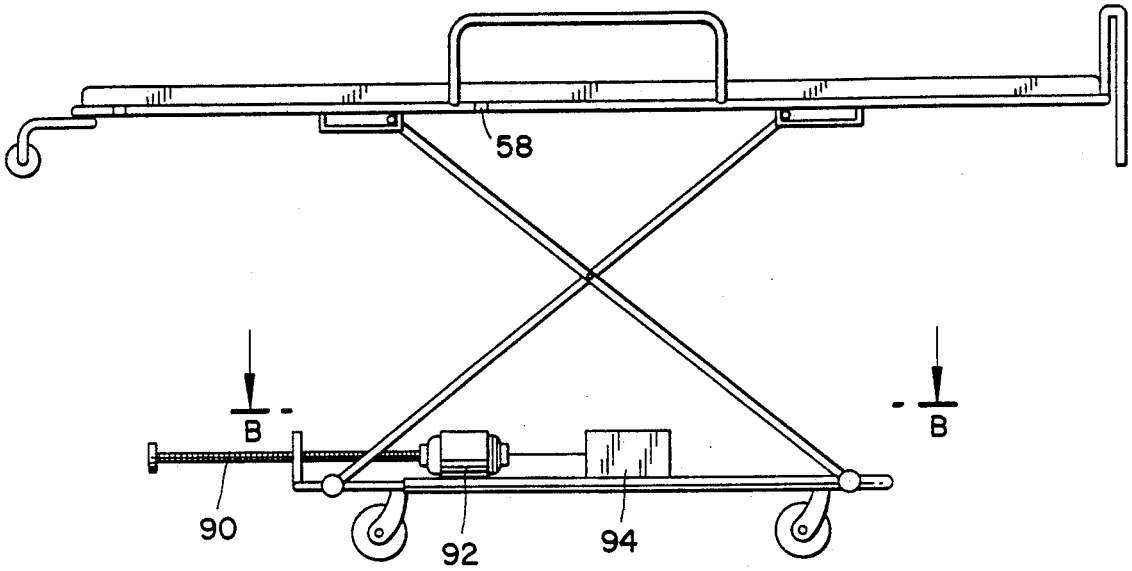
FIG. 12A illustrates a seventh embodiment of the present invention including an electric screw rod.
Figure 12B:
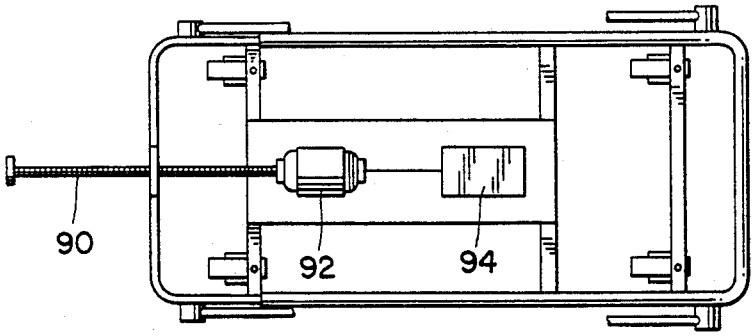
FIG. 12B illustrates the top view of the patient transport device along the line B—B shown in FIG. 12A.
Figure 12C:
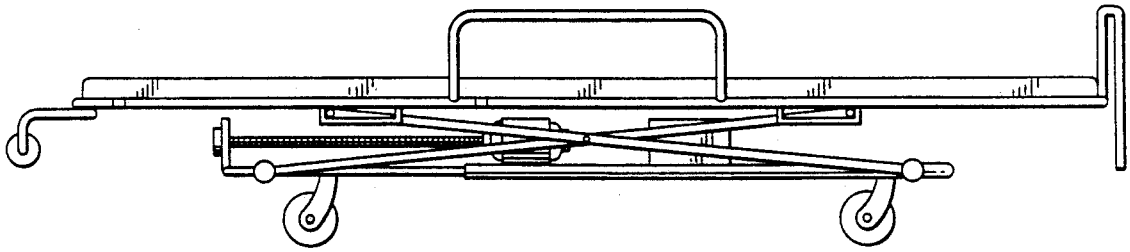
FIG. 12C illustrates the lowered position of the embodiment shown in FIG. 12A.

It will be readily appreciated, however, that other devices can be used to implement the lift assisting means. For example, as seen in FIGS. 12A (raised position), 12B (top view), and 12C (lowered position) a lead screw 90 that is driven by an electric motor 92 can provide the necessary translational movement to assist in lifting and lowering the patient transport device. With this implementation, a portable battery 94 is preferably mounted on the undercarriage 12 to provide the necessary power to drive the motor. Control of the motor can be provided by means of a suitable switch 58 mounted at a convenient location on the patient supporting portion of the device. Additional switches can be placed on the front, rear and other side of the patient supporting device for easy access by the EMS technicians. The switches could be powered either by the battery 94 (in the hydraulic embodiments) or by separate small batteries (not shown).

It is not necessary that the lift assisting mechanism be a motor, however. For example, it would be feasible and within the general objective of the present invention to place tension springs between the opposed ends of the tubular members 1 and 20 which would tend to pull these two members together. This arrangement would cause the device to normally assume its raised position, and would drastically reduce the manual effort required to raise and lower the patient supporting portion when a patient is placed upon it.

Figure 3:
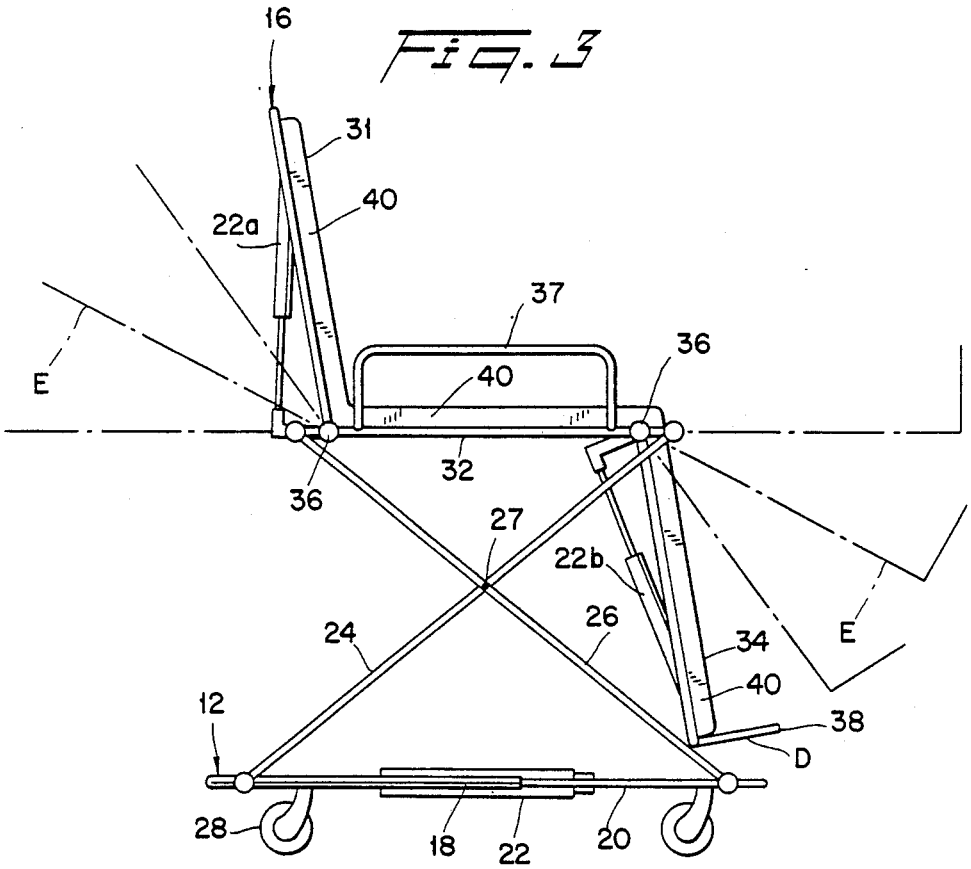
FIG. 3 is a side view illustrating an embodiment of the patient transport device of the present invention having movable sections thereof adjusted relative to each other.

Referring to FIG. 3, the patient supporting portion 16 includes a plurality of sections 31, 32, 34 which are pivotally interconnected at pivot points 36. The sections 31, 32, 34 may be maintained in an in-line configuration C such as that illustrated in FIGS. 1 and 2. Also, the sections 31 and 34 may be moved by actuation of pneumatic cylinders **22*a*, 22*b*, respectively, between the in-line configuration C and a configuration D such as that illustrated in FIG. 3 in which the section 31, which generally supports a patient's upper body portion, is raised, and in which the section 34, which generally supports a patient's legs, is lowered. The section 32, which generally supports a patient's hips, remains in the horizontal position of FIGS. 1 and 2. The sections 31 and 34 are adjustable independently of each other and independently of the section 32 through suitable control of their respective actuators 22*a* and 22*b*, for example by means of valves connecting each to a source of compressed gas. Also, the sections 31 and 34 are adjustable independent of the height adjustment of the patient supporting portion 16 relative to the terrain engaging portion 12**.

Further, the sections 31 and 34 are adjustable to a plurality of dotted line positions E intermediate of the in-line configuration C of FIGS. 1 and 2 and the configuration D of FIG. 3. A collapsible side rail 37 and a foot rest 38 can be included in the frame-work of the patient supporting portion 16. Also, a cushion 40 is typically provided on the patient supporting portion 16 to improve patient comfort. As stated above, to facilitate loading the patient transport device into an ambulance or the like, a slide bar 42 having loading wheels 44 (FIG. 2) can be provided on the underside of the patient supporting portion 16.

Figure 6A:
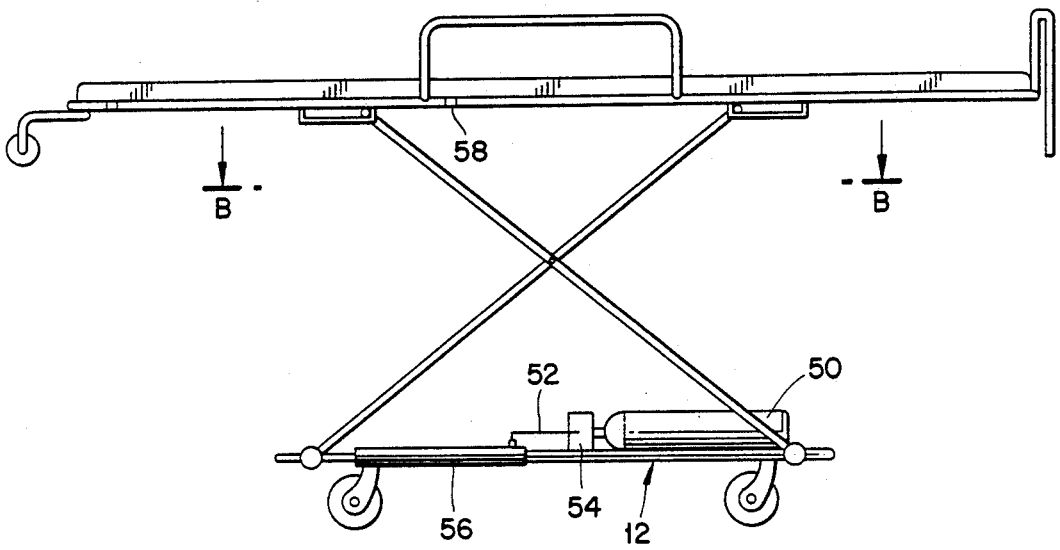
FIG. 6A illustrates the raised position of the patient transport device according to an embodiment including pneumatic cylinders disposed on the undercarriage.
Figure 6B:
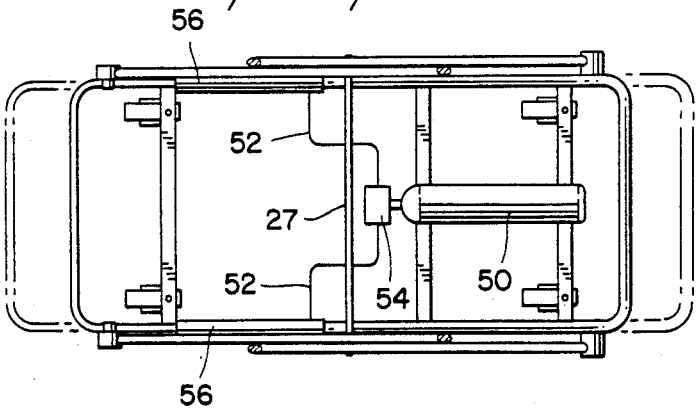
FIG. 6B illustrates the top view of the patient transport device along the line B—B shown in FIG. 6A.
Figure 6C:
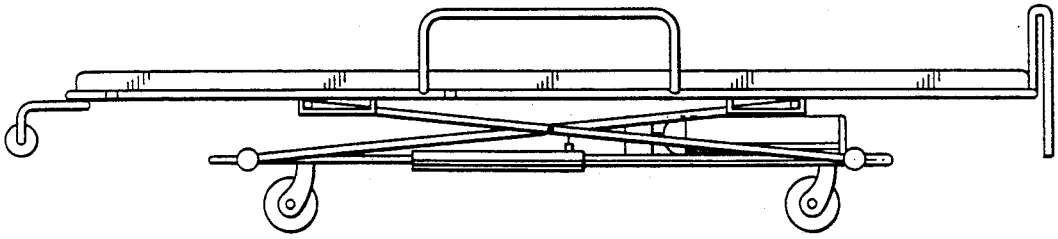
FIG. 6C illustrates the lowered position of the embodiment shown in FIG. 6A.

FIGS. 6A, 6B and 6C illustrate an embodiment of the present invention which include two pneumatic cylinders 56 disposed on the terrain engaging portion 12. Pneumatic cylinders 56 are operated by a compressed air tank 50 which includes a regulator (not shown) and remote controlled valves 54. Supply lines 52 connect the compressed air tank 50 to the pneumatic cylinders 56. A remote control switch 58 is provided on the patient supporting portion 16 for operating the control valves 54. The switch, or switches as discussed above, operate to open and close the valves 54 through wires (not shown) connected to a solenoid (not shown) or some other means of activating electrically controlled valves. Thus, merely by depressing the switch 58, the EMS technician can cause the patient supporting portion, or the terrain engaging portion, to be raised or lowered automatically. No manual effort for lifting or lowering the patient supporting portion is required, other than the depression of the switch.

Figure 7A:
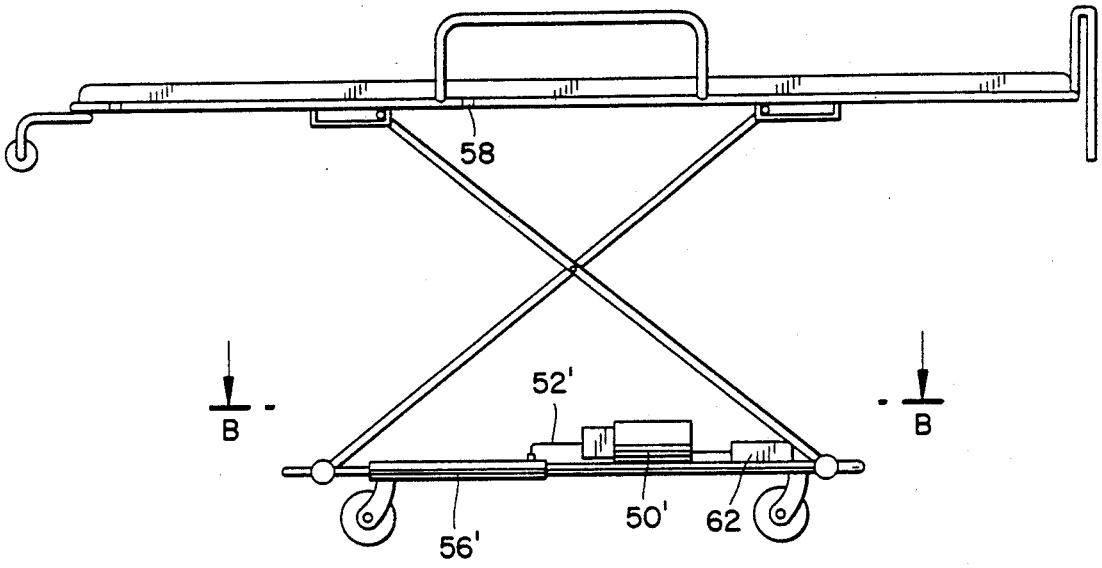
FIG. 7A illustrates an hydraulic/electric design according to a second embodiment of the present invention.
Figure 7B:
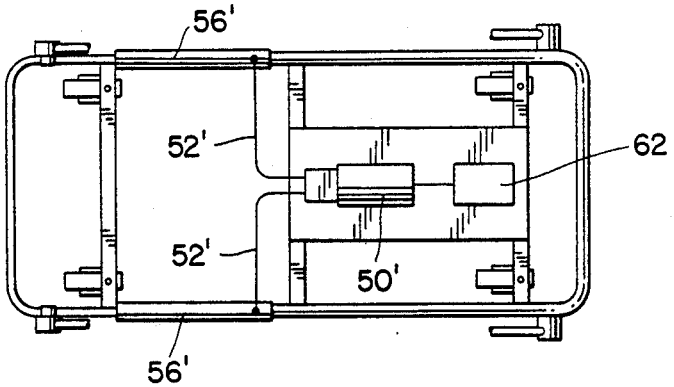
FIG. 7B illustrates the top view of the patient transport device along the line B—B shown in FIG. 7A.
Figure 7C:
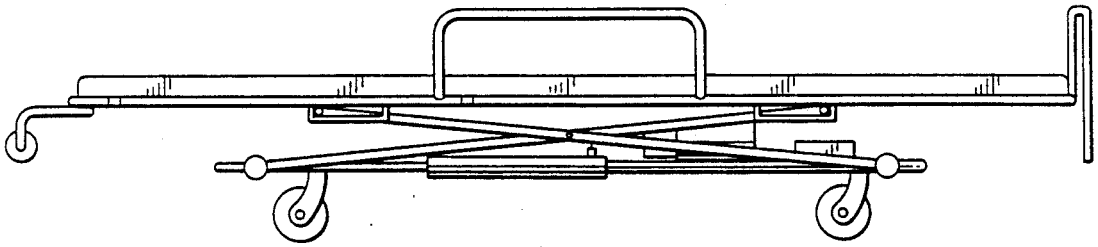
FIG. 7C illustrates the lowered position of the embodiment shown in FIG. 7A.

FIGS. 7A, 7B and 7C show respectively raised and lowered positions of the patient transport device according to the present invention including hydraulic cylinders 56' provided on the undercarriage 12. FIG. 7B illustrates a top view of the terrain engaging portion 12, taken along the line B—B shown in FIG. 7A. The hydraulic cylinders 56' are operated by a hydraulic pump 50' which includes a reservoir (not shown). Supply lines 52' connects the hydraulic pump 50' to the hydraulic cylinders 56'. A battery power source 62 is provided to operate the hydraulic pump 50'. An electric switch 58 is provided to operate the battery source 62 to supply power to the pump 50' in the manner described above with respect to FIGS. 6A–6C.

Figure 8A:
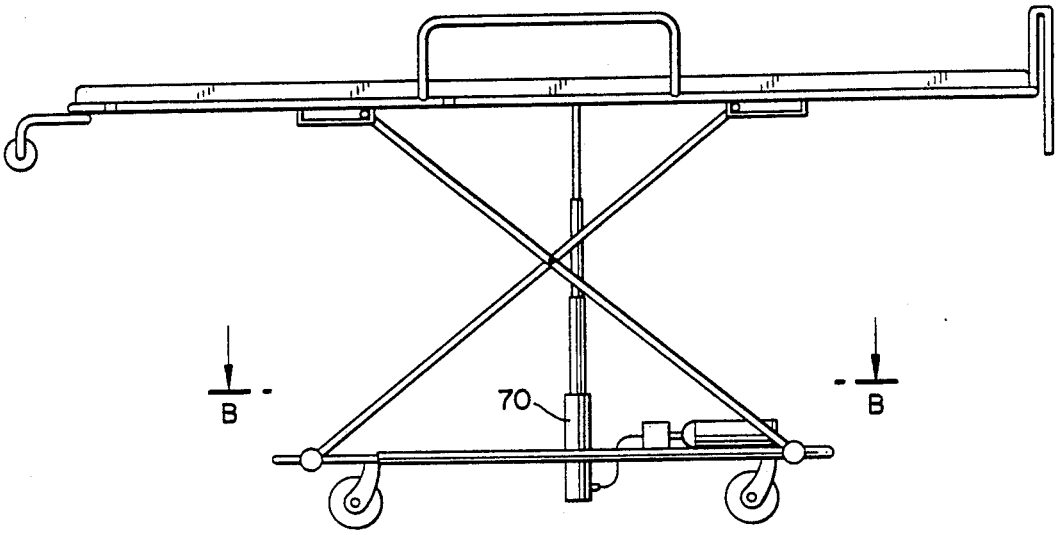
FIG. 8A illustrates a third embodiment according to the present invention including a vertically disposed pneumatic cylinder.
Figure 8B:
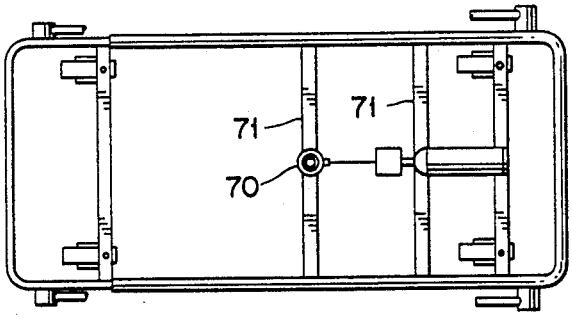
FIG. 8B illustrates the top view of the patient transport device along the line B—B shown in FIG. 8A.
Figure 8C:
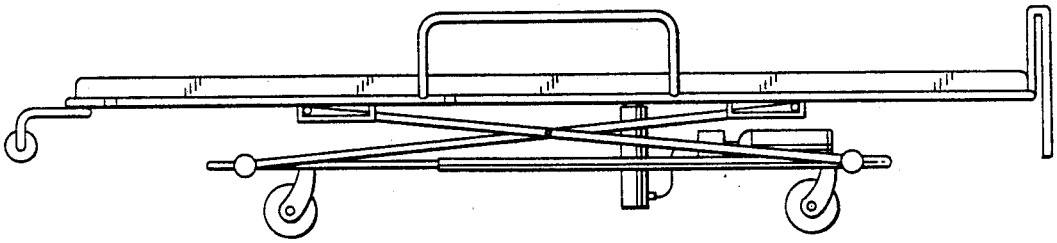
FIG. 8C illustrates the lowered position of the embodiment shown in FIG. 8A.
Figure 9A:
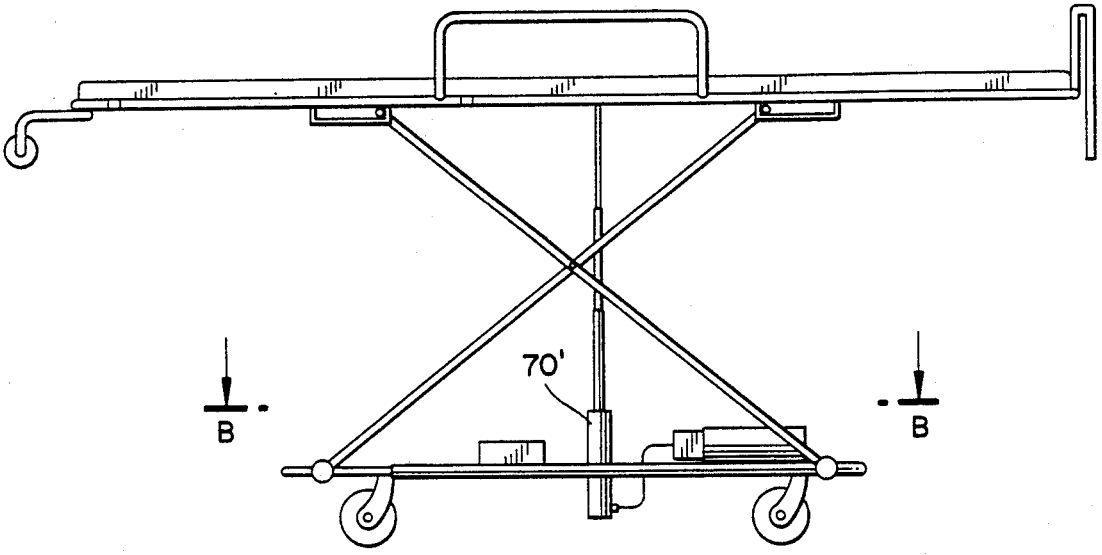
FIG. 9A illustrates a fourth embodiment of the present invention including a vertically disposed hydraulic cylinder.
Figure 9B:
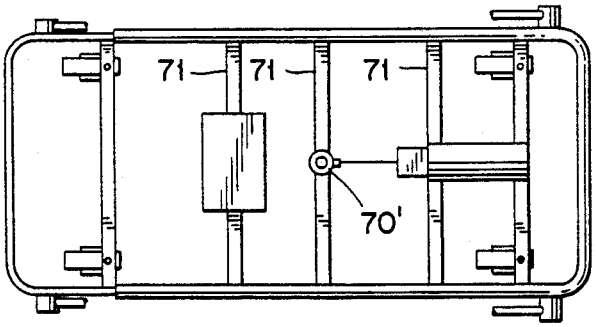
FIG. 9B illustrates the top view of the patient transport device along the line B—B shown in FIG. 9A.
Figure 9C:
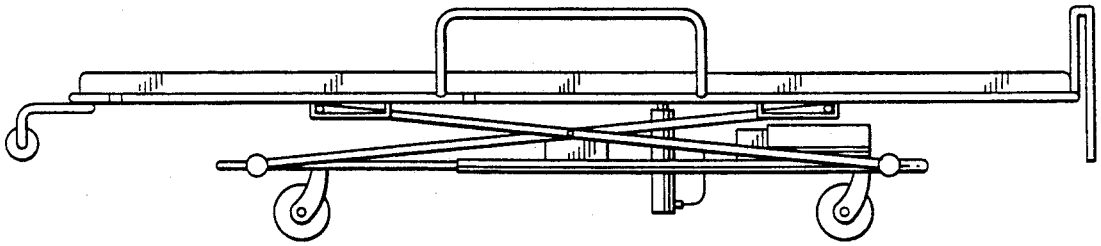
FIG. 9C illustrates the lowered position of the embodiment shown in FIG. 9A.

FIGS. 8A, 8B and 8C illustrate an embodiment of the present invention which includes a pneumatic cylinder 70 connected vertically between the patient supporting portion 16 and the terrain engaging portion 12 of the patient transport device. FIGS. 9A and 9B illustrate a similar embodiment which includes a hydraulic cylinder 70' disposed vertically between the patient supporting portion 16 and the terrain engaging portion 12. In these two embodiments, the vertical cylinder 70, 70' is composed of a telescoping lifting rod to enable the rod to extend to the fullest height necessary in order to transport the patient in the raised position. The rod is connected to cross bars 71 disposed on the patient supporting portion 16 and the terrain engaging portion 12. The remainder of the driving means for driving the cylinders 70, 70' are similar to those described in the embodiment shown in FIGS. 7A, 7B and 7C and 6A, 6B and 6C.

Figure 10A:
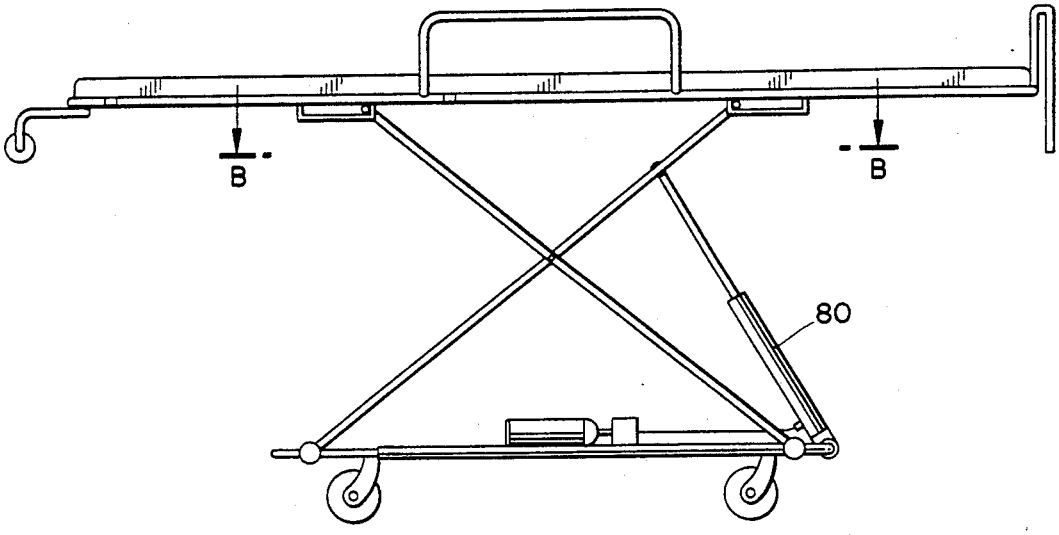
FIG. 10A illustrates a fifth embodiment of the present invention including an angled pneumatic cylinder.
Figure 10B:
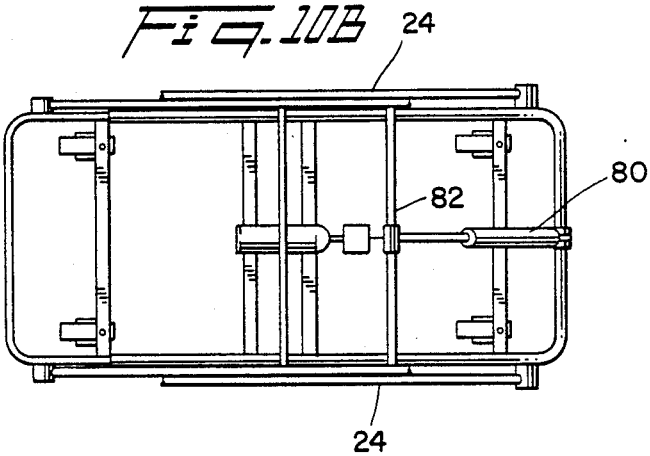
FIG. 10B illustrates the top view of the patient transport device along the line B—B shown in FIG. 10A.
Figure 10C:
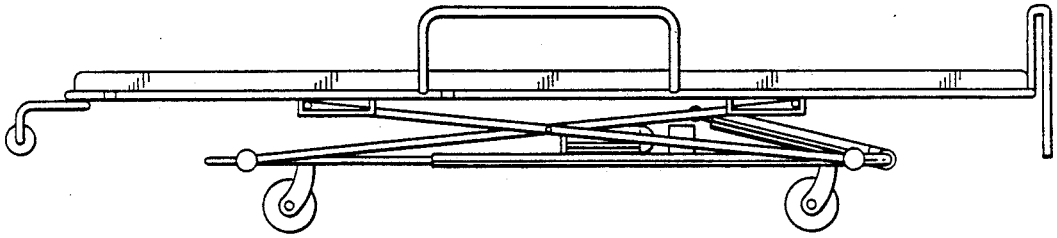
FIG. 10C illustrates the lowered position of the embodiment shown in FIG. 10A.
Figure 11A:
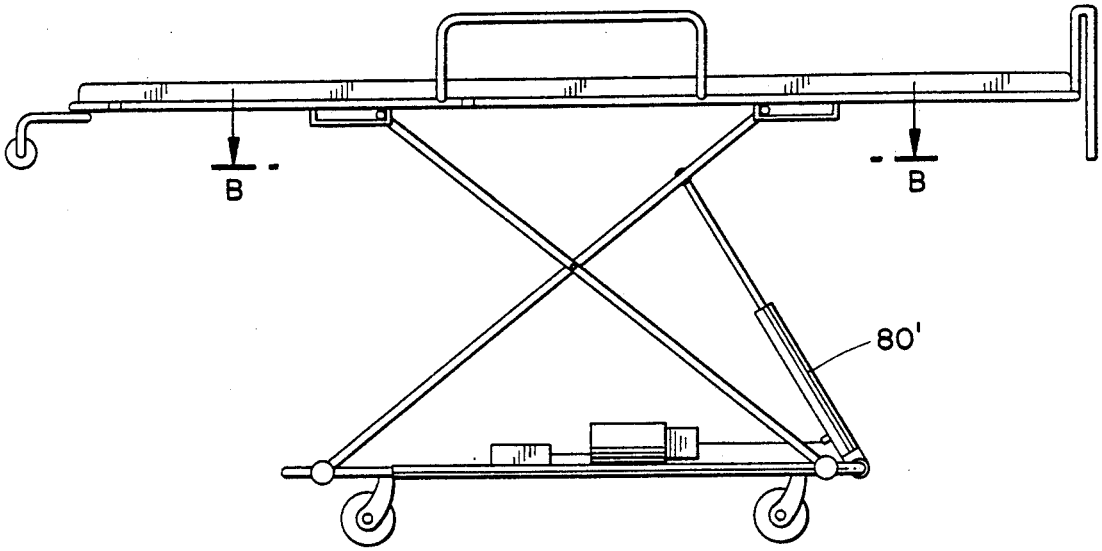
FIG. 11A illustrates a sixth embodiment of the present invention including an angled hydraulic cylinder.
Figure 11B:
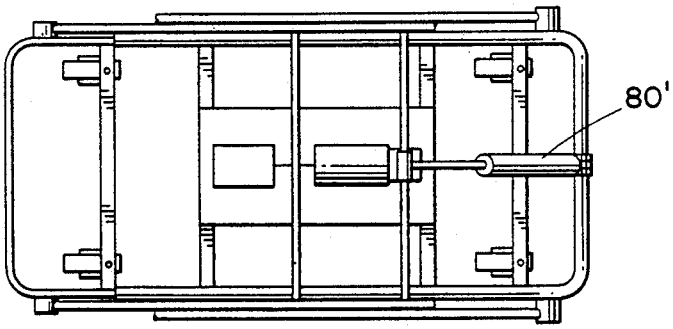
FIG. 11B illustrates the top view of the patient transport device along the line B—B shown in FIG. 11A.
Figure 11C:
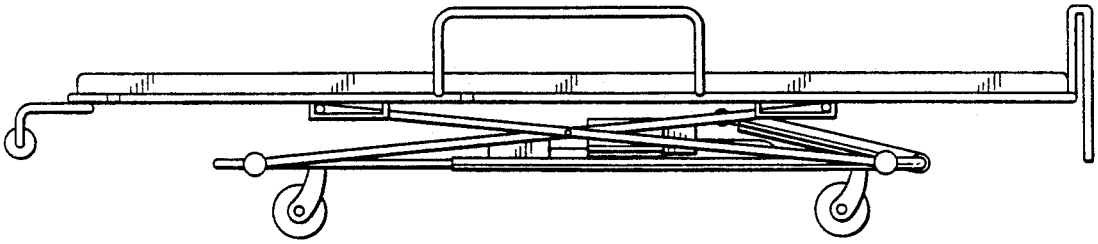
FIG. 11C illustrates the lowered position of the embodiment shown in FIG. 11A.

FIGS. 10A, 10B and 10C illustrate an embodiment of the present invention which includes a pneumatic cylinder 80 which is disposed at an angle relative to vertical. A cross rod 82 is provided between the two legs 24. Another embodiment of the angled cylinder 80' is shown in FIG. 11A, 11B and 11C which illustrate a hydraulic cylinder similar to that shown in FIGS. 7A, 7B and 7C and 9A, 9B and 9C.

Figure 13A:
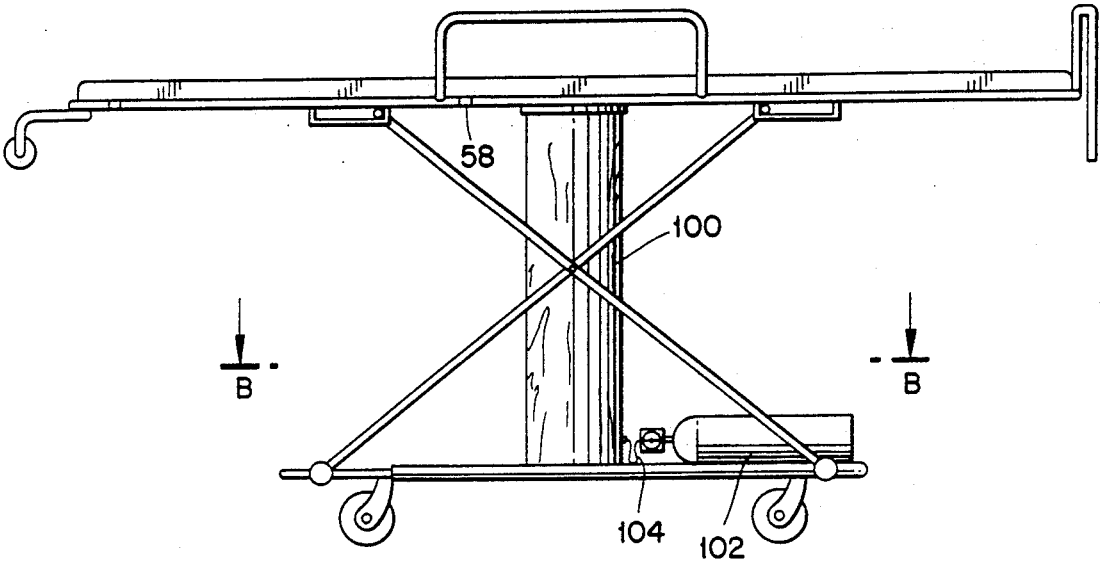
FIG. 13A illustrates an eighth embodiment of the present invention including a vertical pneumatic air bag.
Figure 13B:
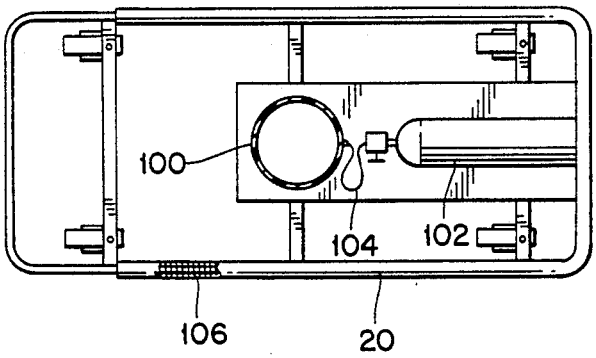
FIG. 13B illustrates the top view of the patient transport device along the line B—B shown in FIG. 13A.
Figure 13C:
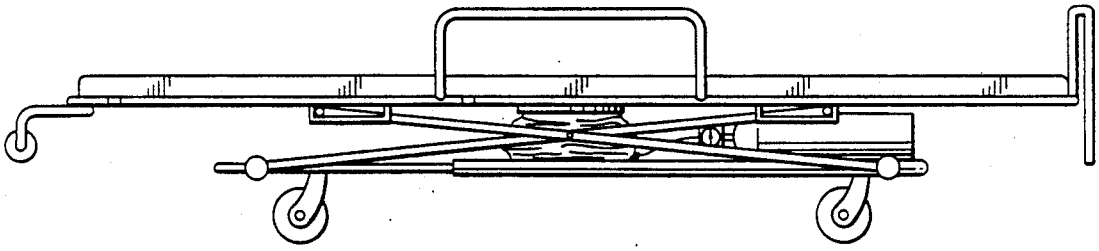
FIG. 13C illustrates the lowered position of the embodiment shown in FIG. 13A.

FIG. 13A, 13B and 13C illustrate another embodiment of the present invention which includes a pneumatic bag 100 connected between the patient supporting portion 16 and the terrain engaging portion 12 of the patient transport device. The pneumatic bag 100 consists of a collapsible air bag cylinder connected through the supply line 104 to a compressed air source 102. The compressed air source 102 includes an air tank, regulator (not shown) and remote controlled valves (not shown). These valves are operated by the electric switch 58 to inflate and deflate the collapsible air bag 100. A low pressure air bag is used which would allow smooth movements between the upper and the lower positions of the patient transport device. Springs 106 are provided inside the tubular members 20 to provide a biasing force against which the air bag 100 works. In the raised position of the device, the springs 106 are compressed, while in the lowered position, the springs 106 are in their non-tensioned state. The springs 106 are placed or fixed between the end of the inner tubular member 20 and the opposite end of the outer tubular member 20. In one possible embodiment, 300 lb. springs can be used.

Although not shown in FIGS. 6A, 6B and 6C through 13A, 13B and 13C, the patient supporting portion of these embodiments may consist of three sections, as shown in FIG. 3.

The foregoing has described a lift-assisted, mobile, field-use patient transport device which enables an EMS crew to avoid much of the lifting involved in moving the patient between the raised and lowered positions on the stretcher. Such structure can reduce the load lifted by the crew in the previously described example by as much as 1000 lbs. Further, when a powered device is used as the lift assisting mechanism, the height of the stretcher can be set at any incremental position between the lowest and highest positions, rather than be limited to a few, fixed number of positions as in conventional, manually operated stretchers.

What is claimed is:

1. A mobile power-adjustable patient transport device for field-use comprising:

a frame, said frame having a terrain engaging portion connected to a patient supporting portion, said patient supporting portion and said terrain engaging portion being height adjustable between a first position and a second position wherein when said portions are in said first position, said patient supporting portion is adjacent said terrain engaging portion and when said portions are in said second position, said patient supporting portion is remote from said terrain engaging portion, said terrain engaging portion comprising:

a first U-shaped member having a transverse portion, and two end portions integral with respective ends of said transverse portion and extending perpendicularly with respect to said transverse portion, a second U-shaped member having a transverse portion, and two end portions integral with respective ends of said transverse portion and extending perpendicularly with respect to said transverse portion, said second member being connected to said first U-shaped member so as to move telescopically with respect thereto such that the end portions of said second U-shaped member are slidably insertable into the respective end portions of said first U-shaped member, wherein said second member is adapted to move between a first position outward with respect to said first member when said patient supporting portion is in said first position and a second position inward with respect to said first member when said patient supporting portion is in said second position;

said transport device further comprising:

two interconnecting arms disposed between said first and second members and in parallel with the ends of said first and second members;

power means having two ends, each end connected to one of said arms for causing said second member to move between said first and second positions for adjusting said height of said patient supporting portion relative to said terrain engaging portion; and switch means operably connected to said power means adapted to be depressed by an operator to actuate said power means, whereby manual height adjustment of said patient supporting portion relative to said terrain engaging portion is avoided, wherein depression of said switch means causes said patient supporting portion to be raised or lowered when said terrain engaging portion is on the ground and said switch means causes said terrain engaging portion to be raised or lowered when said patient supporting portion is suspended over the ground.

2. The device of claim 1, wherein said patient supporting portion includes a plurality of sections whose orientations are adjustable relative to each other.

3. The device of claim 2, further comprising self-contained power means connected to said sections for actuating said sections to move said sections into a plurality of positions independently of each other and independently of said height adjustment.

4. The device of claim 1 wherein said power means comprises a pneumatic cylinder and a tank of compressed gas for actuating said pneumatic cylinder.

5. The device of claim 1 wherein said power means includes an electric motor.

6. A lift-assisted mobile device for transporting patients from one location to another, comprising:

a patient supporting frame for supporting a patient;

an undercarriage for supporting said patient supporting frame, said undercarriage including a rectangular frame having a first portion and a second portion slidably connected to said first portion so as to move horizontally relative to one another, two arms connected between said first and second portions and disposed in parallel with said first and second portions and a scissors linkage having two legs and each leg having a first end connected to said patient supporting frame and a second end connected to said first and second portions, respectively, for connecting said rectangular frame to said patient supporting frame in a manner such that vertical movement of said patient supporting frame relative to said rectangular frame produces corresponding horizontal movement of said portions of said rectangular frame relative one another between a first position where said patient supporting frame is adjacent said undercarriage and a second position where said patient supporting frame is remote from said undercarriage; and lift-assisting means disposed between said first and second portions of said rectangular frame and connected to said arms for causing said first and second portions to move horizontally relative to one another and thereby cause said patient supporting frame to move vertically with respect to said rectangular frame, wherein when said patient supporting frame is in said second position, said first and second portions are disposed in an inner position with respect to one another and when said patient supporting frame is in said first position, said first and second positions are extended outwardly with respect to one another, said lift-assisting means comprising a collapsible air bag connected vertically between said rectangular frame and said patient supporting frame, a tank of compressed air for actuating said bag in response to depression of said switch, and at least one tension spring biasing said two portions of said rectangular frame to move horizontally towards and away from one another; and at least one switch operably connected to said lift-assisting means adapted to be depressed by an operator to actuate said lift-assisting means, whereby manual height adjustment of said patient supporting frame relative to said rectangular frame is avoided, wherein depression of said switch causes said patient supporting frame to be raised or lowered when said undercarriage is resting on a supporting surface and causes said undercarriage to be raised or lowered when said undercarriage is not resting on a supporting surface.

7. A lift-assisted mobile device for transporting patients from one location to another, comprising:

a patient supporting frame for supporting a patient;

an undercarriage for supporting said patient supporting frame at a first position adjacent the ground and a second position substantially elevated above the ground, said undercarriage including a rectangular frame having two portions which move horizontally relative to one another and a scissors linkage which connects said rectangular frame to said patient supporting frame in a manner such that vertical movement of said patient supporting frame relative to said rectangular frame produces corresponding horizontal movement of said portions of said rectangular frame relative one another;

lifting-assisting means disposed between said two portions of said rectangular frame for causing them to move relative to one another and thereby cause said patient supporting frame and said rectangular frame to move vertically with respect to each other, said lift-assisting means comprising a collapsible air bag connected vertically between said rectangular frame and said patient supporting frame, a tank of compressed air for actuating said bag in response to depression of said switch, and at least one tension spring biasing said two portions of said rectangular frame to move horizontally towards and away from one another; and at least one switch operably connected to said lift-assisting means for depression by an operator to actuate said lift-assisting means, whereby manual height adjustment of said patient supporting frame relative to said rectangular frame is avoided, wherein depression of said switch causes said patient supporting frame to be raised or lowered when said undercarriage is resting on a supporting surface and causes said undercarriage to be raised or lowered when said undercarriage is not resting on a supporting surface.

8. The device of claim 7, wherein said patient supporting frame includes a plurality of sections adjustable relative to each other.

9. The device of claim 8, further comprising self-contained power means connected to said section for actuating said sections to move said sections into a plurality of positions independently of each other and independently of said height adjustment.

* * * * *